US011158218B2

(12) United States Patent
Margison

(10) Patent No.: US 11,158,218 B2
(45) Date of Patent: Oct. 26, 2021

(54) ADVERTISING DEVICE CALLED THE SIGN SPINNER

(71) Applicant: Bryant Margison, New Castle, IN (US)

(72) Inventor: Bryant Margison, New Castle, IN (US)

( * ) Notice: Subject to any disclaimer, the term of this patent is extended or adjusted under 35 U.S.C. 154(b) by 0 days.

(21) Appl. No.: 16/793,338

(22) Filed: Feb. 18, 2020

(65) Prior Publication Data

US 2020/0184860 A1 Jun. 11, 2020

Related U.S. Application Data

(63) Continuation-in-part of application No. 15/695,817, filed on Sep. 5, 2017, now abandoned.

(51) Int. Cl.

| | |
|---|---|
| ***G09F 19/08*** | (2006.01) |
| ***G09F 15/00*** | (2006.01) |
| ***G09F 11/02*** | (2006.01) |

(52) U.S. Cl.

CPC ..... *G09F 19/08* (2013.01); *G09F 11/02* (2013.01); *G09F 15/0081* (2013.01); *G09F 2019/086* (2013.01)

(58) Field of Classification Search

CPC ..... G09F 11/02; G09F 19/08; G09F 19/02; G09F 15/0081

See application file for complete search history.

(56) References Cited

U.S. PATENT DOCUMENTS 1,527,024 A * 2/1925 Brookbank ..... G09F 1/14 40/493
1,897,676 A * 2/1933 Ries ..... A47C 3/18 248/417
2,705,381 A * 4/1955 Long ..... G09F 1/14 40/473
3,641,950 A * 2/1972 Axhamre ..... A47F 5/02 108/60
5,054,219 A * 10/1991 Hoyt ..... G09F 7/22 40/473
5,572,816 A * 11/1996 Anderson, Jr. ..... G09F 11/02 40/502
5,921,413 A * 7/1999 Knight ..... A47F 5/05 211/163
6,345,458 B1 * 2/2002 Garibian ..... G09F 15/0037 40/506
6,363,643 B1 * 4/2002 Padiak ..... G09F 7/18 211/103
D483,203 S * 12/2003 Dennig ..... D6/680.2
7,484,324 B2 * 2/2009 Lee ..... G09F 7/22 40/472
2001/0004812 A1 * 6/2001 Lindaman ..... A01M 31/06 43/2
2006/0010738 A1 * 1/2006 Roark ..... G09F 11/02 40/479

* cited by examiner

*Primary Examiner* — Cassandra Davis
(74) *Attorney, Agent, or Firm* — Ritchison Law Offices, PC; John D Ritchison

(57) ABSTRACT

A device as a moving advertising medium which can provide a message with a two- or three-dimensional sign. The device is a simple, non-fully rotatable, back and forth sign system with variable themes and message placards that are easily updated and changed. It includes an exterior vertical tubing component; an interior shaft such as a fiber glass rod with key features, a placard resembling a figure in several typified sections, a gripping frame to hold a message placard, a bearing on the rod; and way to control the back and forth movement.

14 Claims, 7 Drawing Sheets

40A

Electrical system options 61

Sale Today
Sale Today
70
60
41
44
50
37, 37A
Top/Bottom Joined
Optional Cam - See Fig. 5C
45
42
30A
35,36
50

30A 44
43
37,37A
45
43
38C
35

Optional Cam- See Fig. 5C
47
44
48
47
35

49
48A
49A

ADVERTISING DEVICE CALLED THE SIGN SPINNER

CROSS-REFERENCE TO RELATED APPLICATIONS

This application for an Advertising device called the Sign Spinner and is a Continuation-in-Part [C.I.P.] filed under 37 CFR 1.53(b) and claims the benefit of the original, non-provisional (Regular Utility) U.S. patent application Ser. No. 15/695,817 filed and submitted Sep. 5, 2017 and published as US 2018/0068595 A1 on Mar. 8, 2018. The original application was still active on the date of the submission of this C.I.P. The original is entitled a "Advertising device called the Sign Spinner" and was submitted by Bryant Margison, inventor. The original application is incorporated fully by reference as if it were reproduced here, verbatim. The original application claims the benefit of U.S. Provisional Patent Application Ser. No. 62/383,586 filed Sep. 5, 2016 by Bryant Margison and entitled "Special Advertising device called the Sign Spinner".

FIELD OF INVENTION

This invention relates to an Advertising device called the Sign Spinner which is an advertising device. This device relates to outdoor advertising signs. More particularly, this invention relates to a back and forth, non-revolving outdoor advertising sign having a display louver supported thereon. This device is further related to signs, signboards, placards, displays or posters that are used to convey informational or advertising messages and are used to display visual indicia of a promotional or informational nature. Also, this is related to an exterior sign or placard that includes a movable component for attracting attention to the visual message located on the movable component as it is driven by exterior wind currents.

This invention is also related to signs that are lightweight and portable and can be easily assembled. The sign device relates to sign structure, and particularly to wind actuated back and forth, non-rotatable sign structure that is designed to be efficient and cost effective to produce, easy to assemble and disassemble, easy to update a message conveyed by the sign structure, and effectively moved back and forth by air movement in the vicinity of the sign structure, to attract the attention of those in viewing range of the sign structure. The sign device relates to a system for showing displays and in particular, promotional signage.

FEDERALLY SPONSORED RESEARCH

None.

SEQUENCE LISTING OR PROGRAM

None.

BACKGROUND

Field of Invention and Prior Art

As far as known, there are no Advertising device like the Sign Spinner. Manufacturers, retailers, and other business concerns have long sought to sell goods and services by advertising the availability of their products or services to the public. In hand with this, advertising firms have sought to create and market advertising signage which is unique and will not only catch the public's collective eye, but also turn its attention toward the goods and services offered for sale. Advertising sign manufacturers and inventors have worked to meet this demand by designing and manufacturing outdoor display and signage devices which will be readily noticed by the consuming public, and will effectively communicate the advertiser's message to the public in order to promote sales of the goods or services advertised.

As those in the field of art are aware, initial attempts to advertise products for sale used little more than stationary billboards or plaques having an advertising sign displayed on the face thereof. Some of these prior art billboards were equipped to display advertising on both sides. The sides of these prior art billboards were then exposed to public view. Both advertisers and advertising sign manufacturers, however, sought ways to maximize both the return on their investment in advertising costs, and in the manufacture of advertising displays, respectively.

Older designed signs were typically fabricated from die cut panels that could be extruded. These panels often have opposite planar exterior faces with internal transverse webs extending between the two spaced apart faces on which advertising, informational or other visual indicia can be screen printed or otherwise applied. The transverse webs provide rigidity to the panel in much the same way that corrugations impart rigidity to cardboard panels. However, the plastic and foam materials are more impervious to moisture and other environmental contaminants and are therefore more suitable for exterior locations manufactured. Although stationary flat panel signs of this type are suitable for certain applications, they do not provide any means for attracting an observer's attention to the message displayed on the sign. One means for drawing attention to an advertising message is to impart movement to a portion of the sign Which is shown here. However, prior art would rotate fully and would in out of control, leaving some signs as more of a distraction than a communication medium.

Problem Solved

The improvement and problem solved as to spinning signs is that the sign does not fully spin and is easily adapted for specific themes and messages. It is built with lighter materials and made of easily computer-generated sections. In addition, it can be packaged in a flat container to be shipped virtually everywhere and is simple to assemble. As shown by prior art, a traditional sign does not have these features as shown.

Prior Art

The novelty search revealed the following: (a) U.S. Pat. No. 5,054,219 entitled Revolving Sign and Related Drive and issued to Hoyt et al. in 1991; (b) Patent Application US 2006/0010738 called Sign Structure and Related Tool and Method by Roark et al.; (c) U.S. Pat. No. 5,572,816 known as Rotating Advertising Sign with Rotating Louvers and issued to Anderson, Jr. et al. in 1996; (d) U.S. Pat. No. 6,345,458 entitled Rotating Public Information Display Device and issued to Garibian in 2002; (e) U.S. Pat. No. 7,484,324 called Rotary Sign Board and issued to Lee in 2009; and (f) U.S. Pat. No. 8,006,453 called Hanging Display System and issued to Anderson in 2011. A careful analysis reveals none of these anticipate a simple, non-rotatable back and forth sign system with variable themes and message placards that are easily updated and changed like the present Margison device.

SUMMARY OF THE INVENTION

This invention is an Advertising device called the Sign Spinner. Taught here are the ways an advertising medium may provide a message with a two (2) or three (3) dimensional sign and provide an easily changeable message.

The preferred embodiment of an Advertising device called the Sign Spinner is comprised of: (a) a vertical tube such as an electrical metal tubing—EMT pipe/tube—or equal rigid, hollow pole made of metal, fiberglass, wood, pressed material or composite material; (b) a vertical rod such as a fiber glass rod, an electrical metal tubing—EMT pipe/tube, or composite material that is durable and lightweight a fiber glass rod with key components; (c) figures in several sections; (d) a bearing on the rod; (e) a spring on the tube; and a means to mount the tube to a structure or the ground/surface.

The newly invented Advertising device called the Sign Spinner may be manufactured at low volumes by very simple means and in high volume production by more complex and controlled systems.

Objects and Advantages

There are several objects and advantages of the Advertising device called the Sign Spinner that will be included in the Non-provisional application. The device is a simple, non-complex design of readily available materials and a simple and easily changeable message placard.

| Item | Advantage |
|---|---|
| 1 | is non-rotatable, back and forth - back and forth with cam return - not just spin |
| 2 | is wind operate a by air in the vicinity |
| 3 | is cost effective to produce |
| 4 | is easy to assemble and disassemble with simple tools |
| 5 | is light and can be packaged for flat shipments |
| 6 | can target specific types of people and specific messages |
| 7 | able to change and update messages |
| 8 | is readily made medium made of simple materials and components but combined in a unique manner to provide this distinct product |

The Advertising device called the Sign Spinner is a readily made and available advertising medium made of simple materials and components but combined in a unique manner to provide this distinct product.

DESCRIPTION OF THE DRAWINGS—FIGURES

The accompanying drawings, which are incorporated in and constitute a part of this specification, illustrate an embodiment of the Advertising device called the Sign Spinner that is preferred. The drawings together with the summary description given above and a detailed description given below explain the principles of the Advertising device called the Sign Spinner device. It is understood, however, that the Advertising device called the Sign Spinner device is not limited to only the precise arrangements and instrumentalities shown.

FIGS. 1 A through 1 D are sketches of the general Advertising device called the Sign Spinner device.

Figures 4A, 4B:
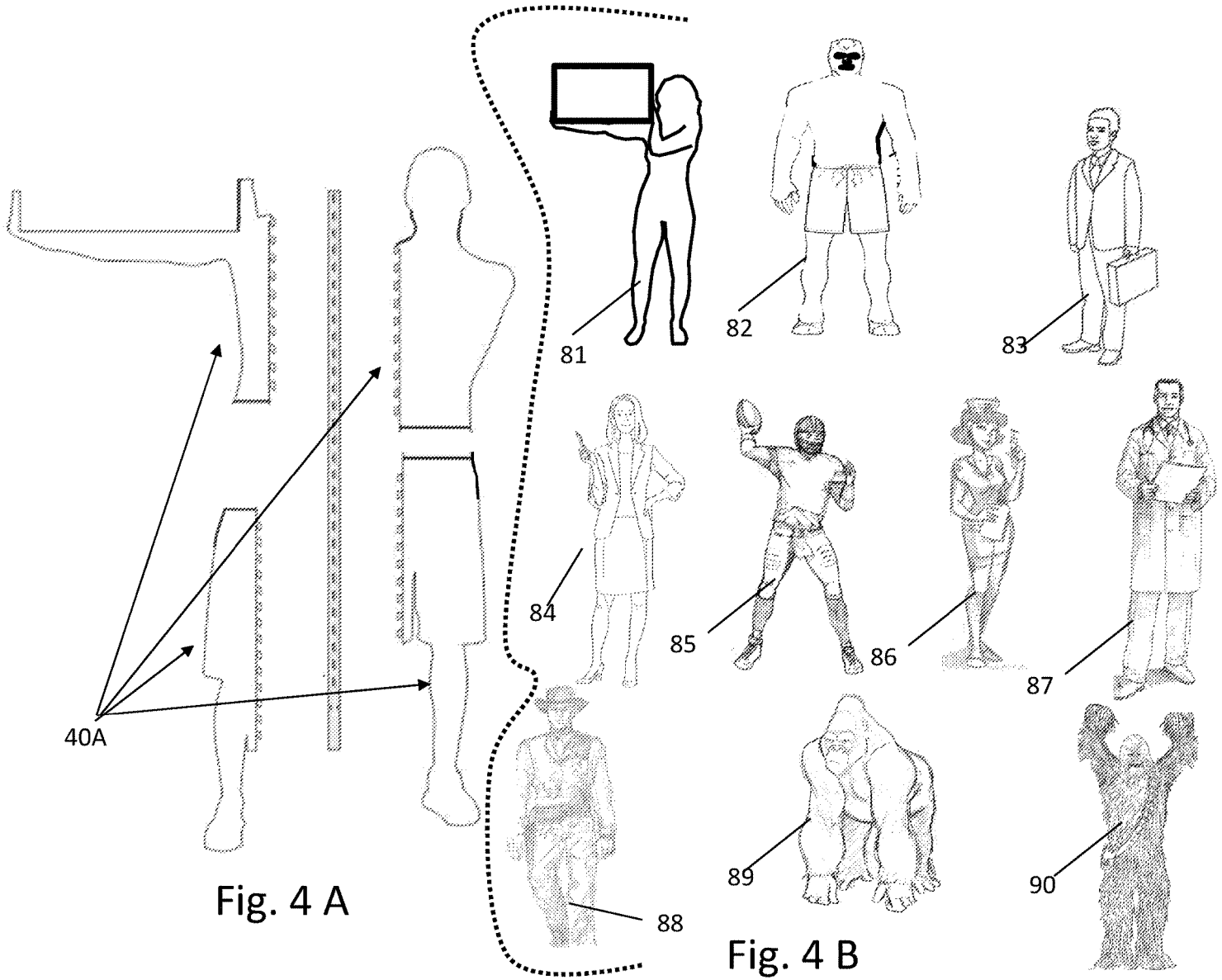

FIGS. 4 A and 4 B are alternative views of the Advertising device called the Sign Spinner.

Figure 5C:
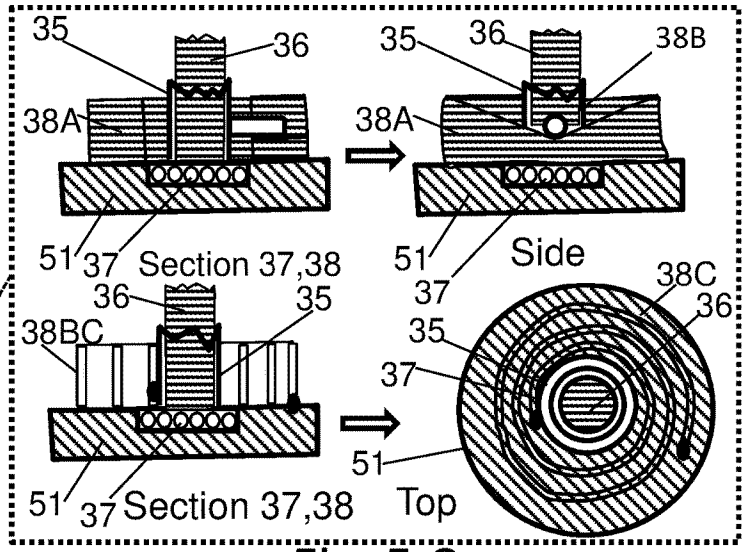
Figure 5B:
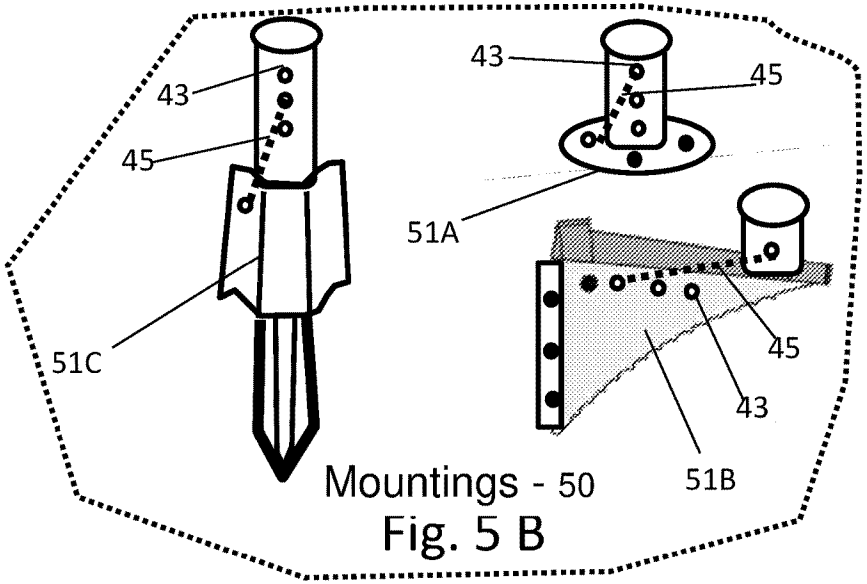
Figure 5A:
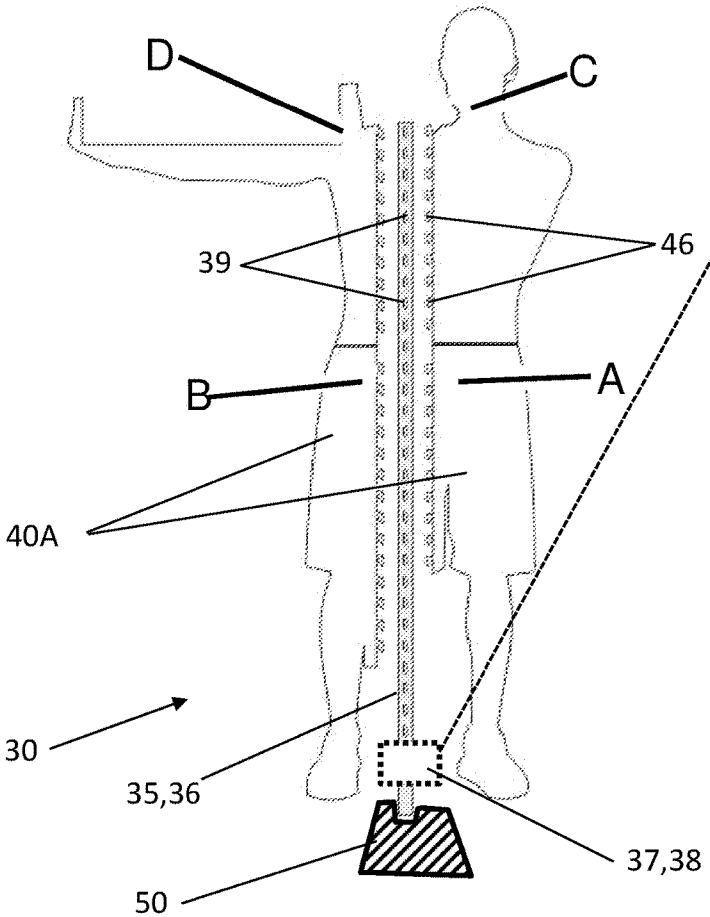

FIG. 5 A through 5 C are a manner to assemble the device and to mount the device.

Figure 6B:
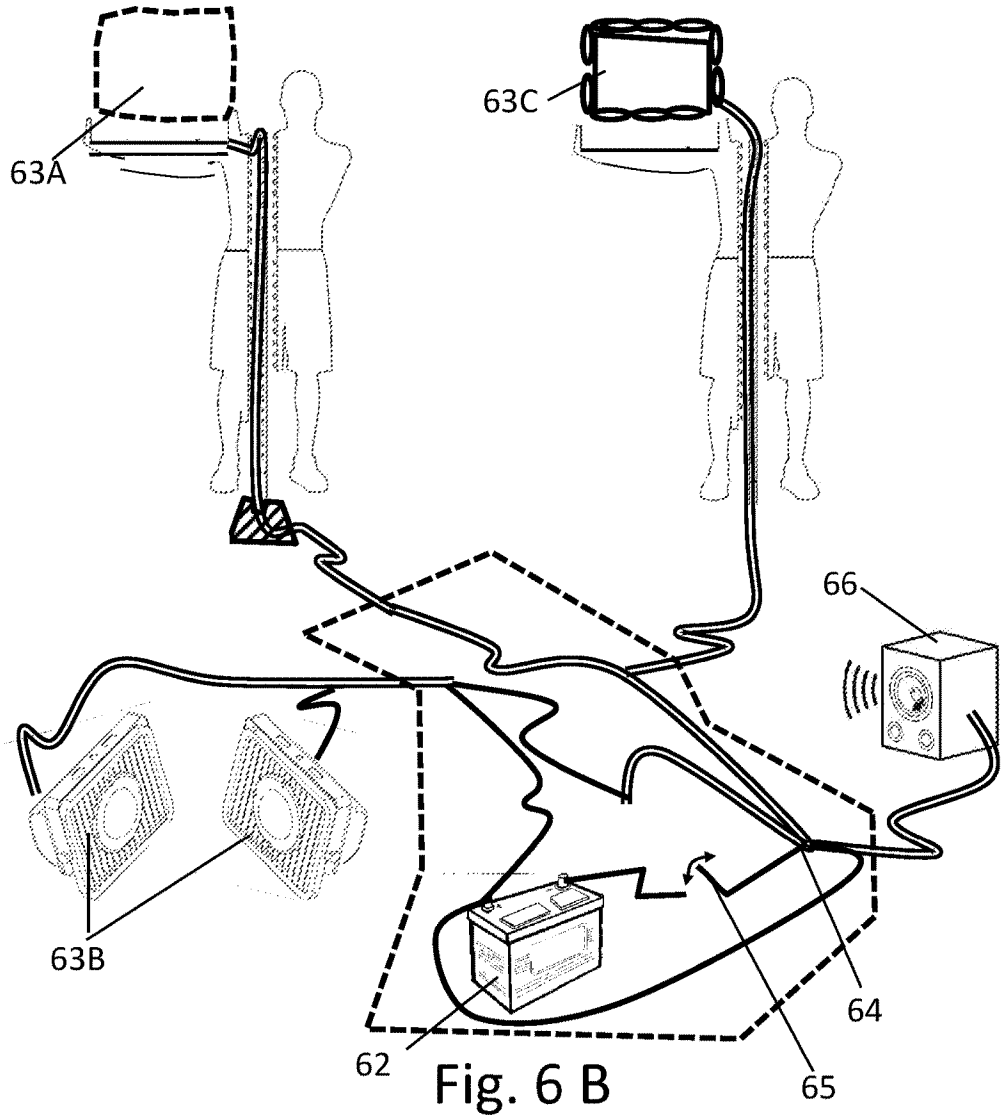
Figure 6A:
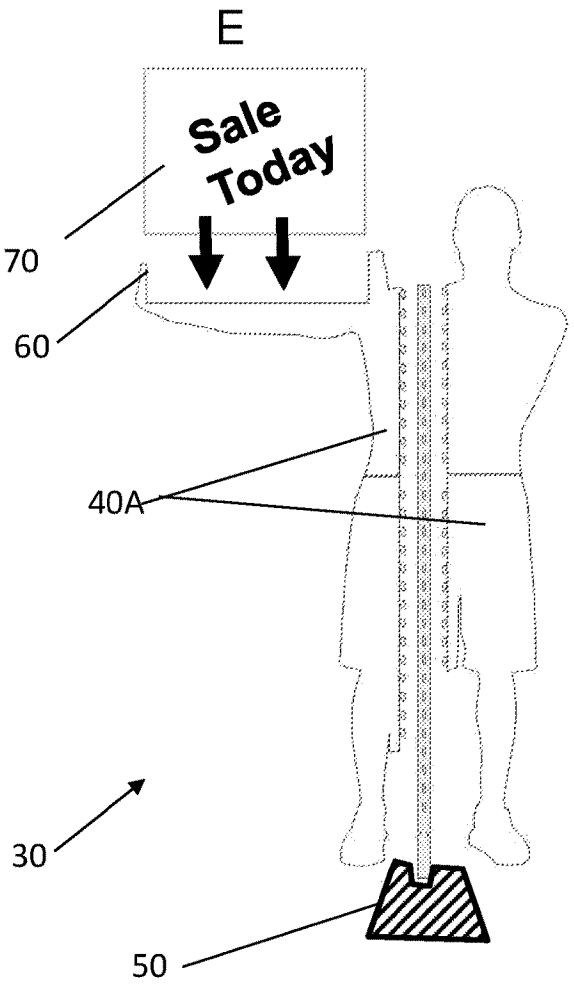

FIG. 6 A is a manner to show the changeable signage and FIG. 6 B are lighting options, both are with the Advertising device 30 called the Sign Spinner.

Figures 7A, 7B, 7C, 7D, 7E:
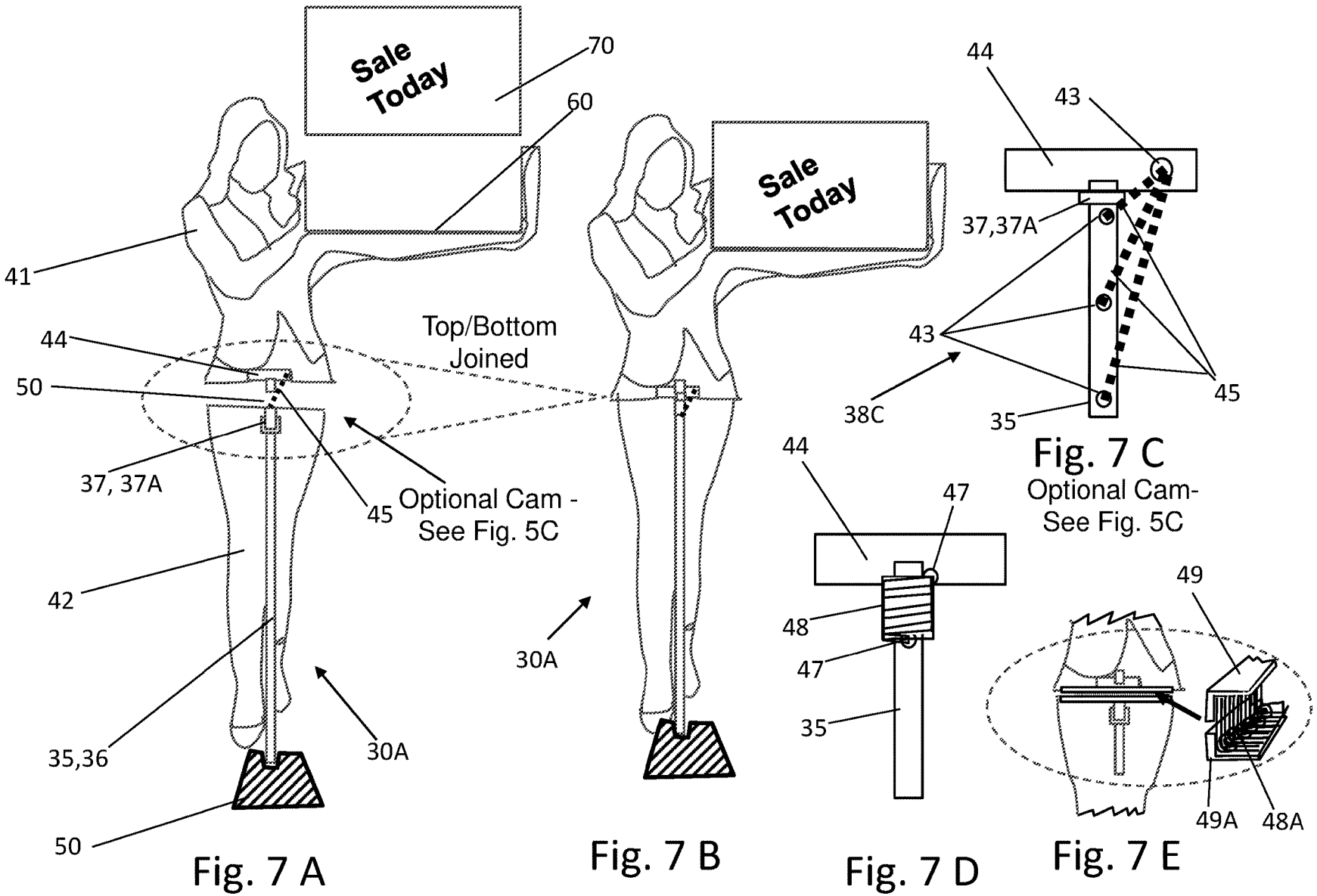

FIG. 7 A through 7 E are manners to have partial or half rotational pieces as well as connections to springs or cams for controlling motion.

DESCRIPTION OF THE DRAWINGS—REFERENCE NUMERALS

The following list refers to the drawings:

TABLE B

Reference numbers

| Ref # | Description |
|---|---|
| 30 | Advertising device 30 called the Sign Spinner |
| 30A | Partial ½, ⅔, ¼ Advertising device 30A called the Sign Spinner |
| 35 | a vertical tube 35 of a length with an interior aperture throughout its length, the tube can be such as an electrical metal tubing - EMT pipe/tube - or equal rigid, hollow pole made of metal, fiberglass, wood, pressed material or composite material - or equal |
| 36 | a vertical rod 36 such as a fiber glass rod, an electrical metal tubing - EMT pipe/tube, or composite material that is durable, lightweight, and solid or hollow |
| 37 | bearing 37 on rod 36 - such as a needle bearing, bushing, or ball bearing and pocket 37A |
| 38 | a means 38 for controlling and limiting the back and forth movement such as a cam 38A and follower 38B or a spring 38C on rod 36 to realign signage and prevent full rotation |
| 39 | keyway apertures/holes 39 in vertical rod 36 to accept keys of the signage components |
| 40 | FIGS. 40 such as lady, bikini girl, man, swimmer, professional, nurse, doctor, cowboy, et al shown in several mirrored sections 40A - A, B, C and D. The figures have tabs along the edge aligned with the rod 36. |
| 40A | mirrored sections 40A such as A, B, C and D |
| 41 | Top portion 41 of FIGS. 40 |
| 42 | Bottom portion 42 of FIGS. 40 |
| 43 | Apertures 43 for spring 45, 48 ends |
| 44 | Base for spring connection 44 |
| 45 | Linear or extension spring 45 with opposite ends |
| 46 | key component tabs 46 along the rod 36 edge of the FIG. 40 to align and fit into keyhole slots 39 to be inserted into the key aperture/hole 39 in vertical rod 36 |
| 47 | Aperture 47 for securing spring 48 ends |
| 48 | Torsional spring 48 |
| 48A | Torsion spring 48A with extended legs |
| 49 | fixture 49 connected to end of tube 35 or rod 36 and end of torsional spring 47 |
| 49A | Angle, tee or flat structure 49A to connect torsion springs 48A to FIGS. 40 and sections 41, 42 |
| 50 | mounting 50 onto surface, building top or side, concrete slab, or another mounting surface |
| 51 | mounting types include a tube and set screw set into a bracket to mount on a horizontal surface 51A, a bracket to mount on a vertical wall surface 51B or a ground spade 51C or the like to removably mount into the ground |
| 60 | signage mount 60 "H" structure to accept signage 70 |
| 61 | options 61 are anticipated as a portable electrical power source 62 such as a battery, a light source 63 such as Light Emitting Diodes (LEDs), group of flood |

TABLE B-continued

| Reference numbers | |
|---|---|
| Ref # | Description |
| | lights or Christmas lights, and the harness of electrical wiring 64 to interconnect the battery 62, light source 63 and switch 65. Anticipated also is an optional sound source 66 run from the system 62, 64, 65. |
| 62 | portable electrical power source 62 such as a battery |
| 63 | light source 63 such as Light Emitting Diodes (LEDs) 63A, group of flood lights 63B or Christmas lights 63C |
| 64 | harness of electrical wiring 64 to interconnect the battery 62, light source and switch |
| 65 | switch 65 |
| 66 | optional sound source 66 run from the power and electrical system 62, 64, 65 |
| 70 | changeable signage 70 held in "H" structure 60 |
| 81 | bikini girl 81 |
| 82 | man swimmer 82 |
| 83 | professional man 83 |
| 84 | professional woman 84 |
| 85 | sports player 85 |
| 86 | nurse 86 |
| 87 | doctor 87 |
| 88 | cowboy 88 |
| 89 | animal such as a gorilla 89 |
| 90 | fictional characters such as Chewbacca (RTM) 90 |

DETAILED DESCRIPTION OF PREFERRED EMBODIMENT

The present development is an Advertising device called the Sign Spinner. This invention relates to an Advertising device called the Sign Spinner which is an advertising device. This device relates to outdoor advertising signs. More particularly, this invention relates to a back and forth, non-revolving outdoor advertising sign having a display louver supported thereon. This device is further related to signs, signboards, placards, displays or posters that are used to convey informational or advertising messages and are used to display visual indicia of a promotional or informational nature. Also, this is related to an exterior sign or placard that includes a movable component for attracting attention to the visual message located on the movable component as it is driven by exterior wind currents. This invention is also related to signs that are lightweight and portable and can be easily assembled. The sign device relates to sign structure, and particularly to wind actuated back and forth, non-rotatable sign structure that is designed to be efficient and cost effective to produce, easy to assemble and disassemble, easy to update a message conveyed by the sign structure, and effectively moved back and forth by air movement in the vicinity of the sign structure, to attract the attention of those in viewing range of the sign structure. The sign device relates to a system for showing displays and in particular, promotional signage.

The advantages for the Advertising device called the Sign Spinner were stated above and succinctly include:

A. is non-rotatable, back and forth—back and forth with cam return—not just spin;

B. is wind operated by air in the vicinity;

C. is cost effective to produce;

D. is easy to assemble and disassemble with simple tools;

E. is light and can be packaged for flat shipments;

F. can target specific types of people and specific messages;

G. able to change and update messages; and

H. is readily made medium made of simple materials and components but combined in a unique manner to provide this distinct product.

There is shown in FIGS. 1-7 a complete description and operative embodiment of the Advertising device called the Sign Spinner. In the drawings and illustrations, one notes well that the FIGS. 1-7 demonstrate the general configuration and use of this product. The various example uses are in the operation and use section, below.

The accompanying drawings, which are incorporated in and constitute a part of this specification, illustrate an embodiment of the Advertising device called the Sign Spinner device 30 that is preferred. The drawings together with the summary description given above and a detailed description given below explain the principles of the device 30. It is understood, however, that the Advertising device called the Sign Spinner device 30 is not limited to only the precise arrangements and instrumentalities shown. Other examples of signage devices and uses are still understood by one skilled in the art of signs and the like to be within the scope and spirit shown here. The preferred embodiment of an Advertising device called the Sign Spinner is comprised of: (a) a vertical tube 35 such as an electrical metal tubing—EMT pipe/tube—or equal rigid, hollow pole made of metal, fiberglass, wood, pressed material or composite material—or equal; (b) a vertical rod 36 with slots 39 such as a fiber glass rod, composite material rod, an electrical metal tubing—EMT pipe/tube, or composite material that is durable and lightweight, the rod 36 with apertures 39 for key components 46 along a set of FIG. 40; (c) the set of FIG. 40 in several sections 40A; (d) a bearing 37 on the rod 36—such as a needle bearing, bushing, or ball bearing; (e) a means 38 for controlling and limiting the back and forth movement such as a cam 38A or a spring 38B on the tube 35 to realign signage and prevent full rotation; and (f) a means to mount 50 the sign to a structure, ground or horizontal surface.

FIGS. 1 A through 1 D are sketches of the general Advertising device called the Sign Spinner device. Shown here is an Advertising device called the Sign Spinner 30, FIG. 40—lady, bikini girl, man, swimmer, professional, nurse, doctor, cowboy, et al in several sections A, B, C and D, and changeable signage 70 held in "H" structure 60.

Figure 1A:
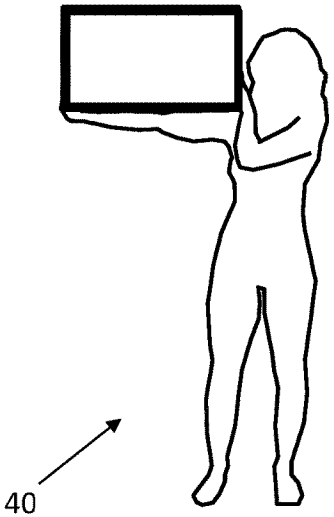
Figure 1B:
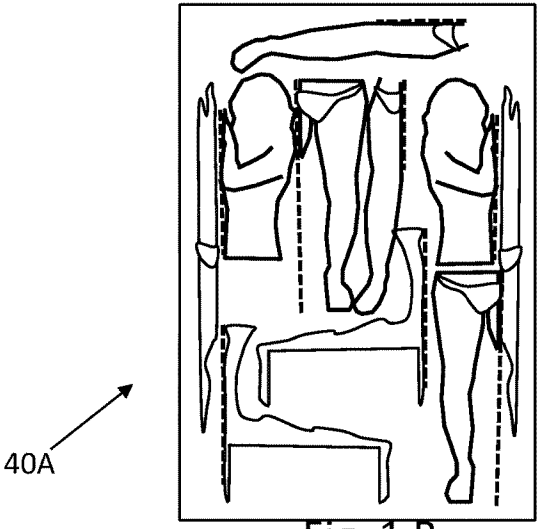
Figure 1C:
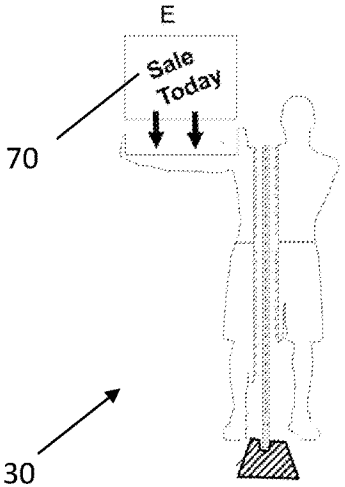
Figure 1D:
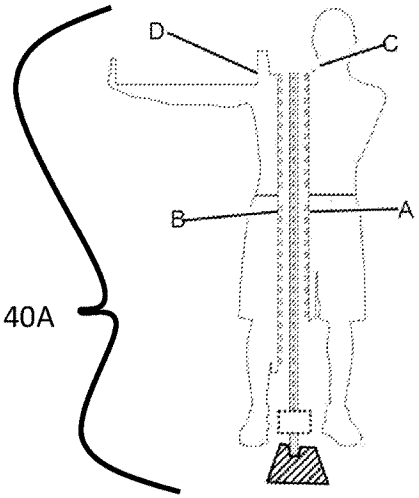
Figure 2:
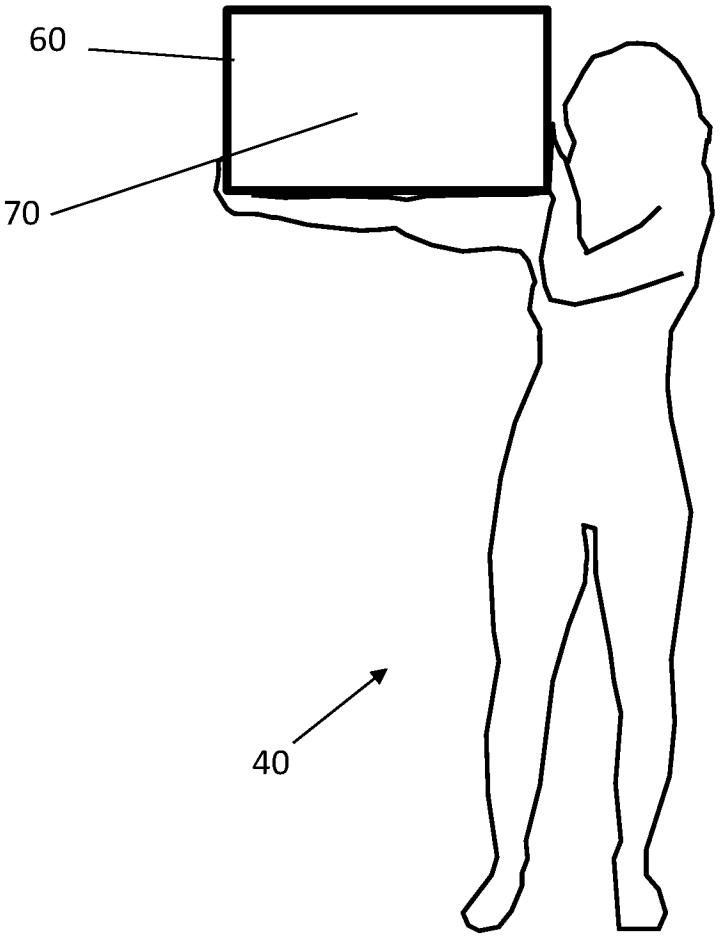
FIG. 2 is a sketch of the general Advertising device called the Sign Spinner with components and features noted.

FIG. 2 is a sketch of the general Advertising device 30 called the Sign Spinner with components and features noted. Demonstrated are: FIG. 40—lady, bikini girl, man, swimmer, professional, nurse, doctor, cowboy, et al in several sections A, B, C and D, and changeable signage 70 held in "H" structure 60. Please see FIG. 4 B.

Figure 3:
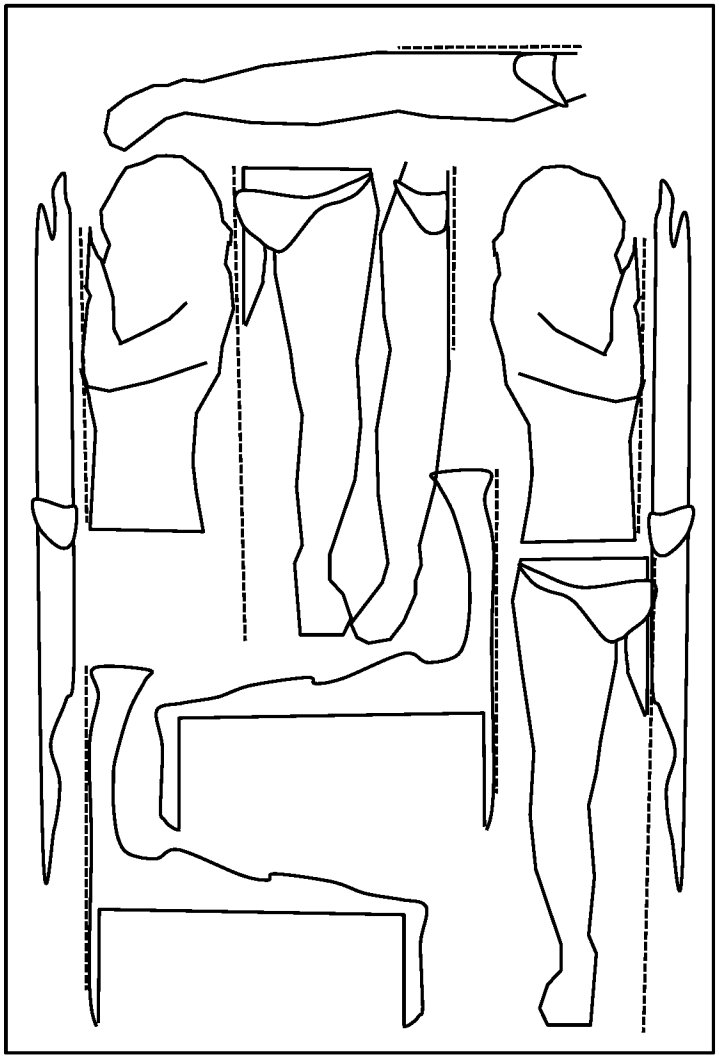
FIG. 3 shows the various sections of the Advertising device called the Sign Spinner.

FIG. 3 shows the various sections of the Advertising device 30 called the Sign Spinner. Viewed here is a FIG. 40—lady, bikini girl, man, swimmer, professional, nurse, doctor, cowboy, et al in several sections A, B, C and D.

FIGS. 4 A and 4 B are alternative views of the Advertising device 30 called the Sign Spinner. Shown is in FIG. 4 A is a view of a male FIG. 40 and sections 40A. FIG. 4 B shows a set of figures as examples and not as limitations. Shown are: a bikini girl 81, a man swimmer 82, a professional man 83; a professional woman 84; a sports player 85; a nurse 86; a doctor 87; a cowboy 88; an animal such as a gorilla 89; and a fictional characters such as Chewbacca® 90.

Materials for the plastic resin panel/FIG. 40 is selected from a variety of resins like polycarbonate (PC), polyester (PET), polyethylene (PE), and acryl. Anticipated are foam boards, heavy and moisture-proof pressed cardboard and composite materials. All these may have built-in colors or surface coating.

FIG. 5 A through 5 C is a manner to assemble the device and mount the device. Demonstrated are an exterior vertical tube 35 such as an electrical metal tubing—EMT pipe/tube—or equal rigid, hollow pole made of metal, fiberglass, wood, pressed material or composite material—or equal; an interior vertical rod 36 such as a fiber glass rod, a composite material rod, an electrical metal tubing—EMT pipe/tube, or composite material that is durable and lightweight; a bearing 37 on rod 36—such as a needle bearing, bushing, or ball bearing; a means 38 for controlling and limiting the back and forth movement such as a cam and follower 38A or a spring 38B on rod 36 and tube 35 to realign signage and prevent full rotation—wherein the cam is attached to near a top of the vertical tube 35 and the follower is attached to or near a bottom end the vertical rod and wherein the spring has one end attached to a bottom end the vertical rod 36 and a second end attached to upper part of the vertical tube 35; keyway apertures/holes 39 in vertical rod 36 to accept keys of the signage components; FIG. 40—lady, bikini girl, man, swimmer, professional, nurse, doctor, cowboy, et al in several sections A, B, C and D—FIG. 40 have tabs along the edge aligned with the rod 36; key component tabs 46 along the fixture 40 to align and fit into keyhole slots 39 to be inserted into the key aperture/hole 39 in vertical rod 36; and mounting 50 onto surface, building top or side, concrete slab, or other mounting surface. Mounting types include a tube and set screw set into a bracket to mount on a horizontal surface 51A, a bracket to mount on a vertical wall surface 51B or a ground spade 51C or the like to removably mount into the ground. Also one can see the apertures 43 for spring 45, 48 ends; a base for spring connection 44; and a set of linear or extension spring 45 with opposite ends.

FIG. 6 A is a manner to show the changeable signage and FIG. 6 B are lighting options, both are with the Advertising device 30 called the Sign Spinner. Provided in these drawings are: FIG. 40—lady, bikini girl, man, swimmer, professional, nurse, doctor, cowboy, et al in several sections A, B, C and D—figures have tabs along the edge aligned with the rod 36; mounting 50 onto surface, building top or side, concrete slab, or other mounting surface; signage mount 60 "H" structure to accept signage 70; and changeable signage 70 held in "H" structure 60. Also shown in FIG. 6 B are anticipated options 61 are anticipated as a portable electrical power source 62 such as a battery, a light source 63 such as Light Emitting Diodes (LEDs), group of flood lights or Christmas lights, and a harness of electrical wiring 64 to interconnect the battery 62, light source 63 and switch 65. Anticipated also is an optional sound source 66 run from the system 62, 64, 65.

FIG. 7 A through 7 E are manners to have partial (⅓, ⅔, ¼) or half (½) rotational pieces as well as connections to springs or cams for controlling motion. The components and features shown here include: a partial ½, ⅔, ¼ Advertising device 30A called the Sign Spinner; a vertical tube 35 of a length with an interior aperture throughout its length, the tube can be such as an electrical metal tubing—EMT pipe/tube—or equal rigid, hollow pole made of metal, fiberglass, wood, pressed material or composite material—or equal; a vertical rod 36 such as a fiber glass rod, an electrical metal tubing—EMT pipe/tube, or composite material that is durable, lightweight, and solid or hollow; a bearing 37 on rod 36—such as a needle bearing, bushing, or ball bearing and pocket 37A; a means 38 for controlling and limiting the back and forth movement such as a cam 38A and follower 38B or a spring 38C on rod 36 to realign signage and prevent full rotation; a top portion 41 of FIG. 40; a bottom portion 42 of FIG. 40; a set of apertures 43 for spring 45 ends; a base for spring connection 44; a linear spring 45 with opposite ends; a set of apertures 47 for securing spring 45 ends; a torsional spring 48; a set of fixtures 49 connected to end of tube 35 or rod 36 and end of torsional spring 48A; a mounting 50 onto surface, building top or side, concrete slab, or other mounting surface; and a signage mount 60 "H" structure to accept signage 70. One can see a straight back and forth movement from the torsion springs 48A with extended ends, the aperture 47 for securing torsion spring 48A with extended legs; the fixture 49 connected to end of tube 35 or rod 36 and end of torsional spring 48A; and the angle, tee or flat structure 49A to mechanically fasten or connect torsion springs 48A to FIG. 40 and portions 41,42.

The details mentioned here are exemplary and not limiting. Other specific components and manners specific to describing an Advertising device called the Sign Spinner device 30 may be added as a person having ordinary skill in the field of the art of signage and advertising devices and their uses well appreciates.

Operation of the Preferred Embodiment

The Advertising device called the Sign Spinner 30 and its operation has been described above. Generally, the basics are after the EMT pipe 35 is inserted onto the fiberglass Rod (E) 36, over the bearing 37 and means 38 attached. The bearing 37 in the base 51A, 51B, or 51C would be free to rotate axially unencumbered. The cam 38A or spring 38B is placed attached to the base and vertical rod 36 to return the sign to a starting position when the wind dies down or disappears entirely. The installer would install pieces 40—A first, then B, then C, then D. The cutout would be full color as in the pictures. The print will be so both sides will look the same, and if one goes to a sign with four (4) sides, then it will be printed and installed in ninety (90) degree increments. Initially, the two (2) dimensional is tried first to see how it works and looks. The girl/figure will be cut out, as one can see, where the cut out will be in the Sign Spinner cut out pieces printed photo (JPEG). This will allow the girl to be fastened onto a piece of EMT (electrical metal tubing) the tubing will be machined out to fit the hooks in the side via the keys 46 on the edge of the fixtures 40 and keyways 39 along the rod 36. After it is all assembled, the figure/girl 40 will be back to a full person. The side where the sign is, will be made of "H" frame aluminum. This will clip to the sign material on one side where the girl is printed, and then clip to the changeable sign on top. So that anyone can change the advertisement as they desire. The sign will either be two (2) sided or four (4) sided. The male version of the sign, shows how the sign material will be attached to the pole.

Various uses and figures in sections are anticipated. These are shown as examples and not as limitations. They include:

| Item | Example of FIG./Use |
|---|---|
| 1 | a bikini girl 81 |
| 2 | a man swimmer 82 |
| 3 | a professional man 83 |
| 4 | a professional woman 84 |
| 5 | a sports player 85 |
| 6 | a nurse 86 |
| 7 | a doctor 87 |
| 8 | a cowboy 88 |
| 9 | an animal such as a gorilla 89 |
| 10 | One of a group of fictional characters such as Chewbacca (RTM) 90 |

With this description it is to be understood that the Advertising device called the Sign Spinner 30 is not to be limited to only the disclosed embodiment of product. The features of the Advertising device called the Sign Spinner 30 are intended to cover various modifications and equivalent arrangements included within the spirit and scope of the description.

Unless defined otherwise, all technical and scientific terms used herein have the same meaning as commonly understood by one of ordinary skills in the art to which these inventions belong. Although any methods and materials similar or equivalent to those described herein can also be used in the practice or testing of the present inventions, the preferred methods and materials are now described. All patents and publications mentioned herein, including those cited in the background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. Various features and aspects of the disclosed embodiments can be combined with or substituted for one another in order to form varying modes of the disclosed inventions. Thus, it is intended that the scope of at least some of the present inventions herein disclosed should not be limited by the disclosed embodiments described above.

Thus the scope of this invention should be determined by the appended claims and their legal equivalents. Therefore, it will be appreciated that the scope of the present invention fully encompasses other embodiments which may become obvious to those skilled in the art and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements/components of the above-described preferred embodiment that are known to those of ordinary skill in the art are expressly incorporated herein by reference and are intended to be encompassed by the present claims. Moreover, it is not necessary for a device or method to address each problem sought to be solved by the present invention for it to be encompassed by the present claims. Furthermore, no element, component, or method step in the present disclosure is intended to be dedicated to the public regardless of whether the element, component, or method step is explicitly recited in the claims.

The terms recited in the claims should be given their ordinary and customary meaning as determined by reference to relevant entries (e.g., definition of "plane" as a tool of a carpenter tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all the items together, or any combination or number of the items. Moreover, terms used in the specification and claims such as have, having, include, and including should be construed to be synonymous with the terms comprise and comprising.

What is claimed as the preferred embodiment of:

1. A moving non-fully rotatable, back and forth sign advertising device (30) called the Sign Spinner is comprised of:

(a) a vertical tube (35) component of a length with an interior aperture throughout its length;

(b) a vertical rod (36) with a key aperture (39) for a key tab (46) and interior to the aperture of the vertical tube (35);

(c) a FIG. 40 made of a lightweight, moisture resistant material and in several sections (40A), the sections having the key tabs (46) along a vertical edge which aligns with key apertures in the vertical rod (36);

(d) a bearing (37) on the rod (36);

(e) a means (38) for controlling a rotation and limiting the movement of the FIG. 40) on the rod (36) to a back-and-forth movement; and (f) a portable electrical power source, a light source and/or a sound system, a harness of electrical wiring to interconnect the power source, the light source and/or the sound system and a switch wherein the device as a moving advertising medium can provide a message with a two- or three-dimensional sign and wherein the device is a simple, non-fully rotatable, back and forth sign system with variable themes and message placards that are easily updated and changed.

2. The device in claim 1, wherein the means (38) for controlling a rotation and limiting the movement comprises a cam and follower, the cam being attached to near a top of the vertical tube and the follower being attached to or near a bottom end the vertical rod.

3. The device in claim 1, wherein the bearing (37) on the rod (36) and the means (38) for controlling a rotation and limiting the movement of the FIG. 40) on the rod (36) to a back-and-forth movement is placed at a position less than full-length of the figure such that only part of the advertising medium moves.

4. The device in claim 3, wherein the means (38) for controlling a rotation and limiting the movement is selected from the group consisting of a linear spring, a torsional spring and a cam and cam follower.

5. The device in claim 3, wherein the only part of the advertising medium moves is selected from the group consisting of ½, ¼, ⅓, and ⅔.

6. The device in claim 1, wherein the means (38) for controlling a rotation and limiting the movement comprises a spring with one end attached to a bottom end the vertical rod and a second end attached to an upper portion of the vertical tube.

7. The device in claim 1, wherein the figure (40) is selected from the group consisting of a bikini girl, a man swimmer, a professional man, a professional woman, sports player, a nurse, a doctor, a cowboy, an animal, and a fictional characters.

8. The device in claim 1, wherein the vertical tube (35) is selected from the group consisting of an electrical metal tubing, a hollow metal tube, a hollow fiberglass tube, and a hollow composite material tube.

9. The device in claim 1 wherein the light source is selected from the group consisting of a Light Emitting Diodes (LEDs), a group of flood lights, and Christmas lights.

10. The device in claim 1 further comprising a mounting (50).

11. The device in claim 10 wherein the mounting (50) is selected from the group consisting of a bracket to mount on a horizontal surface, a bracket mount on a vertical wall surface, and a ground spade to removably mount into a ground.

12. The device in claim 1 wherein a lightweight, moisture resistant material for the FIG. 40) is selected from the group consisting of a plastic resin polycarbonate, a plastic resin polyester, a plastic resin polyethylene, a plastic resin acryl, a foam boards, a heavy and moisture-proof pressed cardboard and a composite material.

13. The device in claim 1 wherein the bearing (37) is selected from the group consisting of a needle bearing, a bushing, and a ball bearing.

14. The device in claim 1 wherein the vertical rod (36) is selected from the group consisting of a fiber glass rod, an electrical metal tubing, and a composite material tubing.

* * * * *